US006464527B2

(12) United States Patent
Volpe et al.

(10) Patent No.: US 6,464,527 B2
(45) Date of Patent: Oct. 15, 2002

(54) QUICK CONNECT COAXIAL CABLE CONNECTOR

(75) Inventors: Frank Volpe, North Haven; Peter Perry, North Branford; Jeffrey Buccitti, Prospect; Thomas Ricard, Cheshire, all of CT (US)

(73) Assignee: EZ Form Cable Corporation, CT (US)

( * ) Notice: Subject to any disclaimer, the term of this patent is extended or adjusted under 35 U.S.C. 154(b) by 0 days.

(21) Appl. No.: 09/818,288

(22) Filed: Mar. 27, 2001

(65) Prior Publication Data

US 2001/0046802 A1 Nov. 29, 2001

Related U.S. Application Data

(60) Provisional application No. 60/192,380, filed on Mar. 27, 2000.

(51) Int. Cl.[7] ..... H01R 13/627

(52) U.S. Cl. ..... 439/352; 439/439; 439/357

(58) Field of Search ..... 439/352, 578, 439/353, 354, 355, 356, 357, 345, 350, 358

(56) References Cited

U.S. PATENT DOCUMENTS 4,533,194 A * 8/1985 Boichut ..... 339/91

4,915,651 A * 4/1990 Bout ..... 439/578

* cited by examiner

*Primary Examiner*—P. Austin Bradley
*Assistant Examiner*—Alexander Gilman
(74) *Attorney, Agent, or Firm*—Anthony J. Casella; Gerald E. Hespos

(57) ABSTRACT

A coaxial connector assembly is provided with first and second coaxial connectors. A tubular adaptor is threaded engaged with external threads on the first connector, and includes a locking groove in an outer circumferential surface. A lock body surrounds the second connector, and includes a mating end with a plurality of resiliently deflectable fingers. Each finger includes an inwardly projecting lock bead that engages the lock groove on the adaptor when the connectors are mated. The lock body further includes an annular lock groove in an outer surface. A locking ring surrounds the lock body and includes a forward end which surrounds the resilient fingers of the lock body. The locking ring further includes rearwardly extending fingers that releaseably engage the lock groove in the lock body. The locking ring can be moved between forward and rearward positions. In the forward position, the locking ring engages the resilient fingers of the lock body for securely locking the resilient fingers of the lock body in the groove of the adaptor. In a rearward position, the locking ring permits outward deflection of the resilient fingers on the lock body and hence permits connection or disconnection of the first and second connectors.

7 Claims, 2 Drawing Sheets

QUICK CONNECT COAXIAL CABLE CONNECTOR

This application claims priority on U.S. Provisional Patent Application No. 60/192,380, filed Mar. 27, 2000.

BACKGROUND OF THE INVENTION

1. Field of the Invention.

The subject invention relates to a coaxial connector assembly that enables quick connection for high frequency signal transmission.

2. Description of the Related Art.

A prior art coaxial cable comprises an inner conductor, an insulation material surrounding the inner conductor, an outer conductor surrounding the insulation material and an outer insulating sheath surrounding the outer conductor. The inner conductor is used for carrying signals, and often very high frequency signals. The outer conductor functions as a shield to prevent a degradation of the signal carried by the inner conductor.

The prior art coaxial cable typically is connected to an electrical apparatus that generates or receives the signal carried by the cable. A large number of coaxial cables may lead into and/or out of the electrical apparatus. Each cable must have a secure mechanical and electrical connection of both the inner and outer conductors to the apparatus to ensure that the signal is not degraded at the connection.

Signal generating or processing devices often are reconfigured, updated or repaired. Such changes typically require the coaxial cables to be disconnected and then reconnected. As a result, the connections between coaxial cables and the signal generating or processing apparatus can not be a permanent connection, and coaxial connectors are used to mate a coaxial connector to a signal processing or generating apparatus. A coaxial connector must perform several functions, and the relative importance of the functions will vary depending upon the environment in which the connector is used. More particularly, a coaxial connector must enable transmission of the signal across the mated inner conductors. The coaxial connector also must achieve and maintain a ground across the outer conductors for efficient shielding. The connectors also must be engaged securely with one another and must be capable of periodic disconnection and reconnection.

Coaxial connectors frequently are used with home entertainment equipment. The ease of connection and disconnection of coaxial connectors in this environment is less important because disconnection and reconnection occurs relatively infrequently and because the owner of such equipment typically will not be under time pressure to make a rapid disconnection and reconnection.

Other coaxial connectors are used in a high vibration environment. In these situations, it is important to provide a connection that will not disengage in response to vibrations.

Still other coaxial connectors are used for very high frequencies. In these situations, convenience of disconnection and reconnection may be sacrificed to ensure an ability to carry high frequency signals across the connector without significantly affecting the quality of the signal.

The size and signal carrying ability of a coaxial connector often is quantified by standards developed for the military. In particular, military specifications define dimensional and performance standards for a Sub-Miniature Series A connector. Connectors that meet this standard have many non-military applications and are identified commercially as SMA coaxial connectors. A typical prior art SMA connector assembly includes one connector with an externally threaded outer shell formed from a metallic material that forms a part of the ground or shield around the connector. The opposed connector has a metallic lock nut with an array of internal threads. The lock nut is engaged threadedly with the external threads on the shell of the mating connector and also is connected to the outer conductor on the cable. Thus, threaded engagement of the two mated connectors provides continuity of the outer conductor across the connection.

SMA connectors perform their signal carrying function very well and are employed widely throughout the telecommunication, computer and home entertainment industries. However, as noted above, many signal generating or processing devices have a large number of coaxial connectors. The connectors often are arrayed densely on a panel of the device and require connection to a corresponding number of coaxial cables. In a typical situation, the panel mounted connector on the signal processing device will have an outer shell formed with an array of external threads. A typical mating SMA connector will have a corresponding lock nut that must be threadedly engaged with the externally threaded outer shell on the panel of the signal processing device. The threaded connection of a large number of lock nuts on the coaxial cables to the threaded outer shells of the panel-mounted connectors requires a considerable amount of time and hence imposes a significant cost penalty in industries where such connections are connected and disconnected with some regularity. Additionally, the dense arrays of coaxial connectors on panels complicate the threaded connection and reconnection.

Some coaxial connectors are designed for push-pull connection, and hence do not require the physically cumbersome and slow process of threadedly connecting a lock nut of a cable mounted connector to a threaded outer shell of a panel mounted connector. However, many of these quick-connect push-pull connectors are specially manufactured and differ substantially from the SMA dimensional specifications. Additionally, most equipment manufacturers are reluctant to adopt an entirely new connector as an alternate to the widely accepted SMA connectors. Furthermore, many prior art quick-connect push-pull connectors are mechanically complex and costly. Other less expensive push-pull coaxial connectors provide poor signal carrying capability and have a mechanical connection that is unacceptable for high vibration environments.

Accordingly, an object of the subject invention is to provide a coaxial connector that can be connected and disconnected easily and that provides a high frequency signal carrying capability.

SUMMARY OF THE INVENTION

The subject invention is directed to an adaptor for a coaxial connector, such as an SMA coaxial connector. Additionally, the subject invention is directed to a coaxial connector assembly with an adaptor that permits a mechanically secure quick connection/disconnection with an ability to carry high frequency signals.

The adaptor of the subject invention may be employed with a conventional prior art SMA female connector that may be mounted to the panel of a signal processing device. The connector includes a center conductor, a dielectric or an insulating material surrounding the center conductor and an outer conductor concentric with the center conductor. The outer conductor may be mounted to the panel of a signal processing device and is provided with a cylindrical outer shell having an array of external threads formed thereon.

The adaptor of the subject invention is a generally cylindrically tubular member formed from a metallic material, such as beryllium, with acceptable signal carrying characteristics. The adaptor includes a mounting end and an opposite mating end. The mating end may be characterized by an inwardly extending annular shoulder. Portions of the adaptor between the opposed ends include an array of internal threads dimensioned for threaded engagement with the external threads on the shell of the outer conductor of the prior art SMA connector. The outer surface of the adaptor is substantially smoothly cylindrical at most locations between the opposed mounting and mating ends. However, the outer cylindrical surface is characterized by an annular groove that preferably is disposed at a location closer to the mounting end of the adaptor.

The connector assembly of the subject invention further includes a coaxial connector that may be mounted to a coaxial cable. The coaxial connector includes a center contact surrounded by a dielectric or insulating material. A conductive plug body is mounted to and surrounds the insulator and concentrically surrounds the center contact of the coaxial connector. The plug body includes a rear mounting end that is connected to the outer conductor of the cable to provide a continuous shielding and grounding at the interface of the cable and the connector. The plug body also includes an annular undercut extending around the rear end.

A lock body surrounds the plug body and projects forwardly therefrom. More particularly, the lock body includes a rear mounting end and a front mating end. The rear mounting end may include an inwardly directed annular flange dimensioned and configured for secure permanent mating with the annular undercut at the rear of the plug body. Portions of the lock body that surround and engage the plug body may define a continuous cylinder that closely engages and retains outer circumferential surface portions of the plug body. An annular groove is formed in an outer circumferential surface of the lock body. The lock body further includes a plurality of resiliently deflectable fingers that project forwardly beyond both the center contact and plug body. The front ends of the fingers are characterized by inwardly directed beads dimensioned and configured for engaging in the circumferential groove in the outer surface of the adaptor. Additionally, the front ends of the fingers on the lock body have outwardly facing lock shoulders.

The connector assembly further includes a locking ring that surrounds the lock body and that is axially movable thereon. The locking ring includes a continuous annular forward end that surrounds and engages shoulders of the forward ends of the locking fingers of the lock body. Thus, the annular front portion of the locking ring prevents the outward deflection of the fingers on the lock body that would be required for the lock body to engage with or disengage from the annular locking groove in the adaptor. The locking ring further includes a plurality of resiliently deflectable fingers that project rearwardly from the continuous annular front portion of the locking ring. The fingers include inwardly directed detents that engage in the annular groove formed in the rearward position on the lock body.

An axially directed rearward force on the locking ring will cause the resiliently deflectable fingers of the locking ring to bias outwardly and out of the locking groove on the lock body. Continued rearward forces on the locking ring then will permit axial movement of the locking ring relative to the lock body. Sufficient axial movement of the locking ring will cause the annular front locking portion of the locking ring to move rearwardly from the locking shoulders on the fingers of the lock body. Hence, the locking fingers of the lock body can deflect resiliently outwardly. Conversely, forward movement of the locking ring will position the annular front locking portion of the locking ring on the locking shoulders of the lock body and will position the detents on the locking fingers of the locking ring in the annular lock groove of the lock body.

The connector assembly of the subject invention is used by threadedly mounting the adaptor housings onto the standard SMA connectors. This threaded mounting can be carried out by automated equipment under factory conditions prior to mounting the female SMA connectors onto the panel of the signal processing device. The lock plug assembly then is permanently mounted to a cable substantially as with any prior art coaxial connector.

The plug assembly can be mounted to the adaptor on the SMA connector merely by pulling the lock ring rearwardly on the lock body sufficiently for the annular locking position front of the locking ring to clear the locking shoulders of the fingers on the lock body. The plug then can be mated with the assembled adaptor and SMA connector. In particular, the center contact of the plug is mated with the center contact of the SMA connector. The plug body then is telescoped into the front end of the shell of the SMA connector. Simultaneously, the resiliently deflectable fingers of the lock body telescope over the adaptor. Sufficient advancement will cause the inwardly directed beads on the fingers of the lock body to align with the lock groove on the adaptor. The fingers then will resiliently return toward and undeflected condition and into locking engagement with the lock groove on the adaptor. The locking ring then can be advanced forwardly toward the SMA connector, such that the continuous annular front end of the locking ring surrounds and engages the locking shoulders of the fingers on the lock body, and such that the inwardly directed detent on the rearwardly directed fingers of the locking ring engage in the annular lock groove near the rear end of the lock body.

The subject assembly enables connection of the plug with the standard SMA connector without threaded interconnection at the site of the mating. Additionally, the assembly enables a mechanically secure high frequency connection that can be completed quickly and easily.

Additionally, the locking engagement of the resilient fingers of the lock body and the lock ring provides a clear audible and tactile indication that a secure and complete mating has been effected.

DETAILED DESCRIPTION OF THE PREFERRED EMBODIMENT

Figure 1:
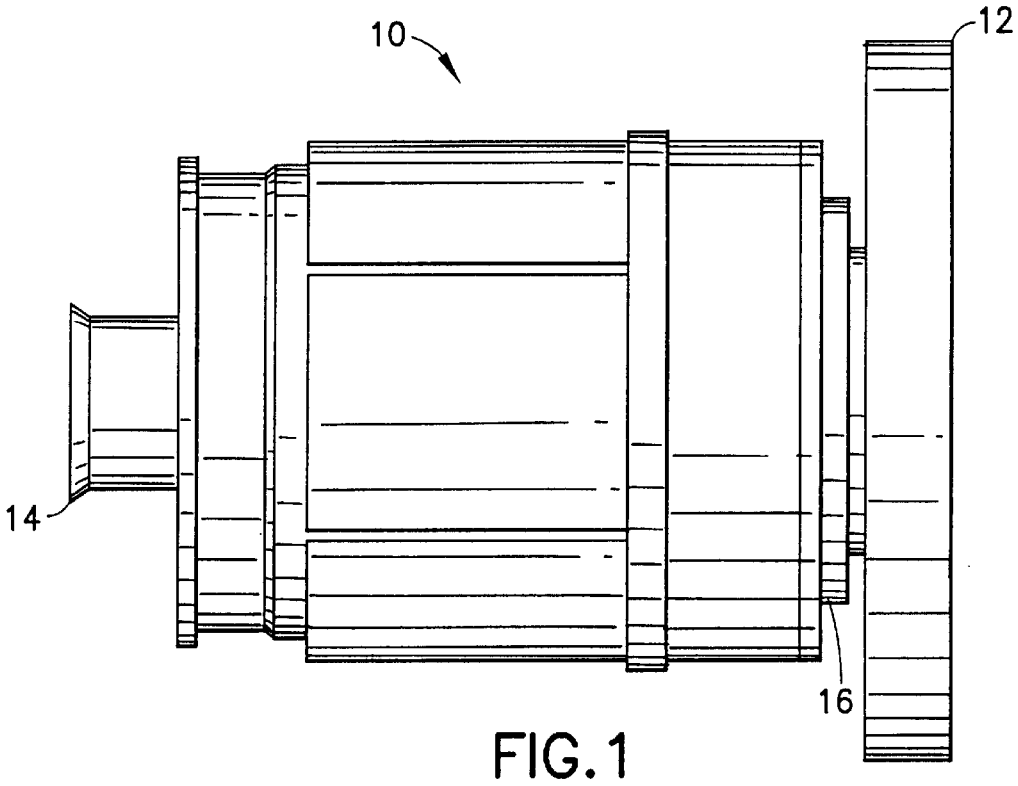
FIG. 1 is a side elevational view of a connector assembly in accordance with the subject invention.
Figure 2:
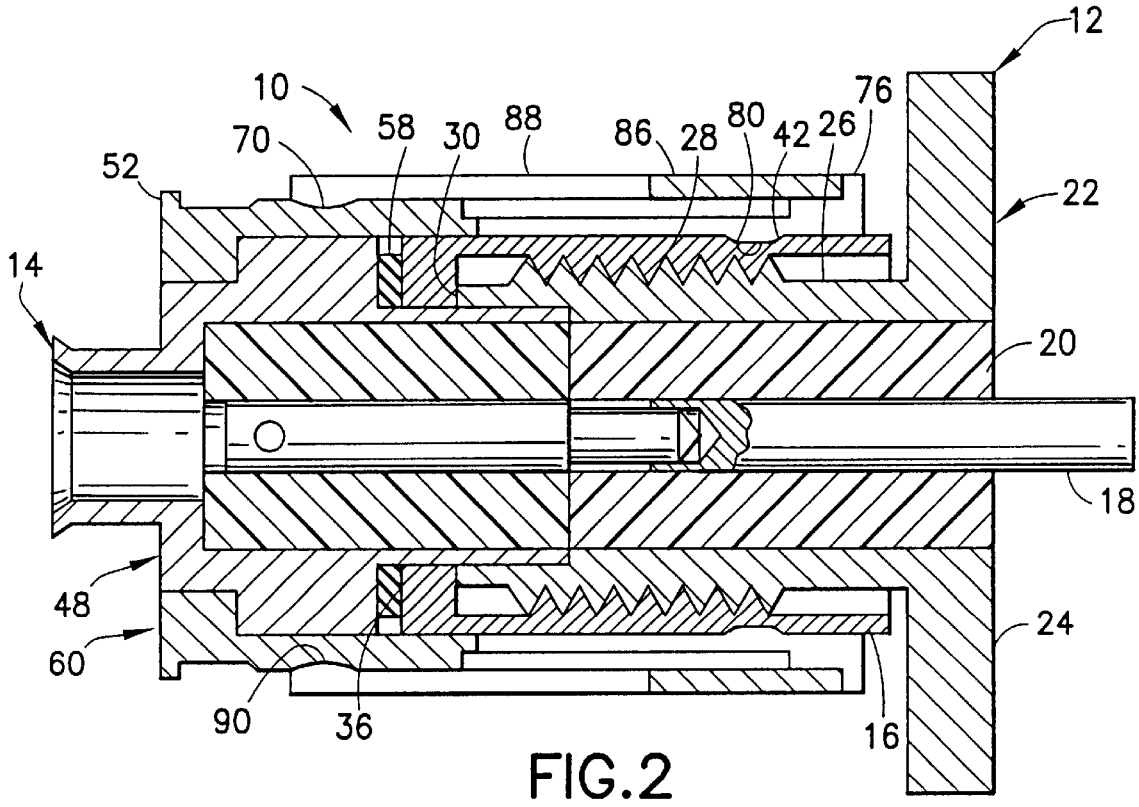
FIG. 2 is a cross-sectional view taken along lines 2—2 in FIG. 1.

A connector assembly in accordance with the subject invention is identified generally by the numeral 10 in FIGS. 1 and 2. The connector assembly 10 includes a conventional female SMA connector 12, a plug connector assembly 14 and an adaptor 16. As shown most clearly in FIG. 2, the female SMA connector 12 includes a female center contact 18. A cylindrical insulator 20 surrounds and closely engages the center contact 18. An outer conductor 22 surrounds and closely engages the insulator 20. The outer conductor 22 includes a mounting end 24 in the form of a flange for mounting to an appropriate signal generating or processing apparatus (not shown). The outer conductor 22 further includes a generally cylindrical shell 26 that closely engages the cylindrical insulator 20. Outer circumferential surface portions of the cylindrical shell 26 are characterized by an array of external threads 28. Additionally, the cylindrical shell 26 projects axially beyond the insulator 22 to a front mating end 30. Portions of the shell 26 between the insulator 20 and the front mating end 30 define an inside diameter that is larger than the outside diameter of the insulator 20. This portion of the outer shell 26 will telescope around the outer conductor of a mating connector as explained further herein. The female SMA connector 12, as described above, is shown in the prior art.

Figure 3:
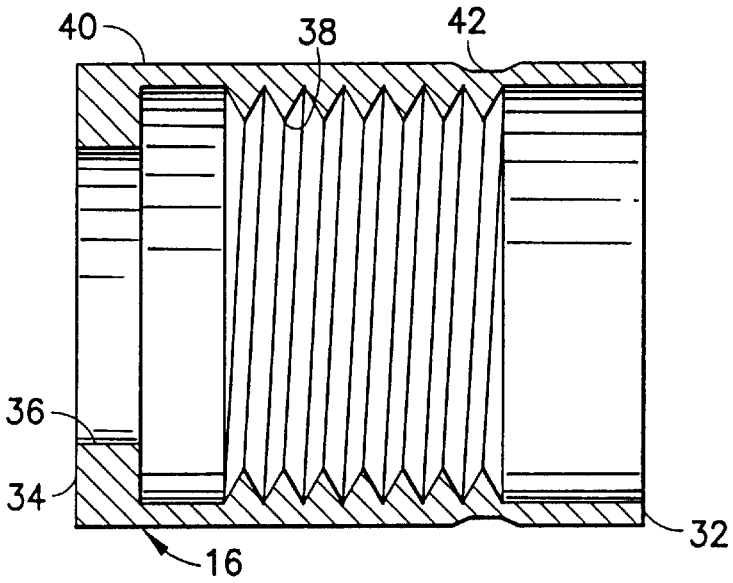
FIG. 3 is a cross-sectional view of the adaptor housing shown in FIG. 2.
Figure 4:
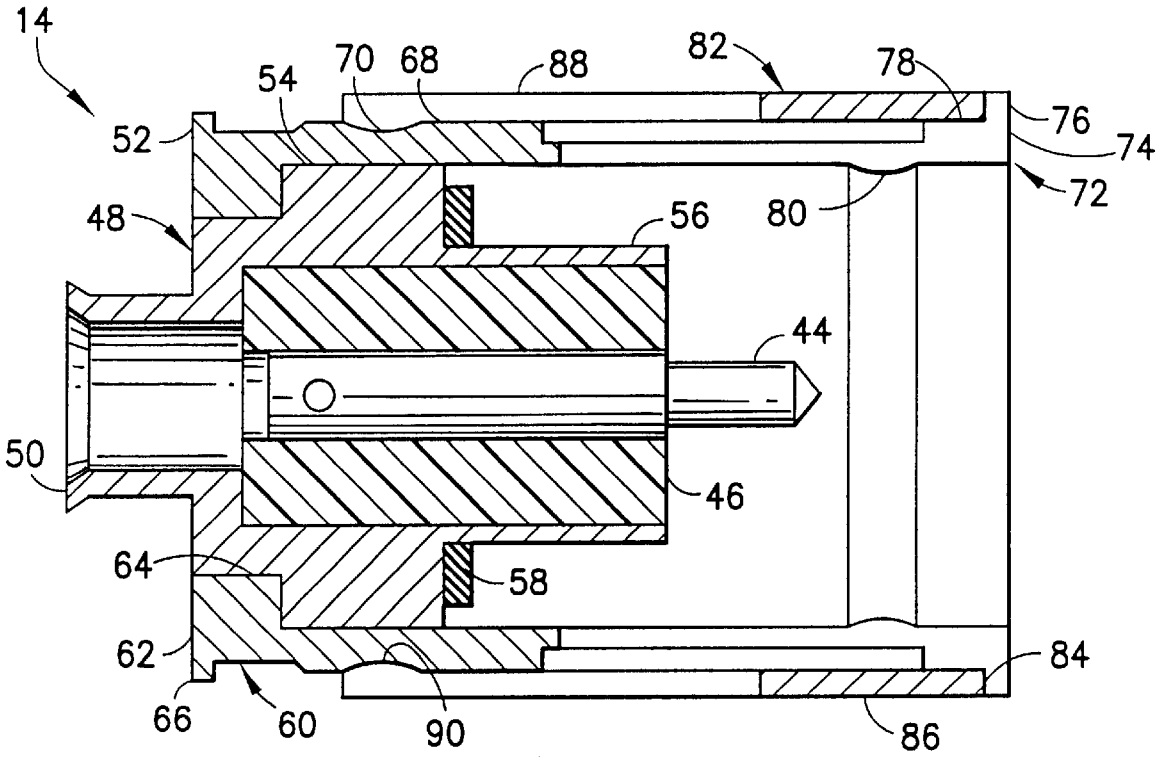
FIG. 4 is a cross-sectional view of the plug assembly shown in FIGS. 1 and 2.

The adaptor 16 of the connector assembly 10 is shown most clearly in FIG. 3. The adaptor is formed from a conductive metal, such as beryllium, and is of generally hollow cylindrical construction. The adaptor 16 includes a rear mounting end 32 and a front mating end 34 characterized by an inwardly extending annular flange 36. Portions of the adaptor 16 forward of the rear mounting end 32 and rearward of the flange 36 define an array of internal threads 38 configured for threaded engagement onto the external threads 28 of the female SMA connector 12. The adaptor 16 further includes an outer surface 40 that is cylindrical along most of the length of the adaptor 16. However, the outer surface 40 is characterized by an annular locking groove 42 extending entirely around the adaptor 16 at a location closer to the rear mounting end 32 than to the front mating end 34.

The plug 14 of the connector assembly 10 includes a center contact pin 44 dimensioned for mating with the center contact 18 of the female SMA connector 12. A cylindrical insulator 46 surrounds and engages portions of the contact pin 44. However, the contact pin 44 projects forwardly beyond the insulator 46 to enable mating with the female SMA connector 12. A plug body 48 surrounds and engages the insulator 46. The plug body 48 includes a rear end 50 for mounting to a cable and for electrical connection with the outer conductor of the cable. The plug body 48 further includes an inwardly formed mounting step 52 having an outwardly facing surface and a rearwardly facing surface near the rear end 50 of the plug body 48. A cylindrical outer surface 54 extends forwardly from the mounting step 52 and defines a major outside diameter for the plug body 48. A mating portion 56 projects forwardly from the major diameter portion 54 to the front end of the insulator 46. The mating portion 56 defines an outside diameter substantially equal to the inside diameter of the outer shell 26 of the female SMA connector adjacent to the front mating end 30 of the outer shell 26, and substantially equal to the inside diameter of the flange 36 on the adaptor 16. Thus, the mating portion 56 of the plug body 48 can be telescoped through the flange 36 of the adaptor 16 and into mating engagement within the front mating end 30 of the outer shell 26 of the female SMA connector 12.

A gasket 58 surrounds the mating portion 56 of the plug body 48 and is positioned adjacent the major diameter portion 54. The gasket 58 preferably is formed from a conductive material, such as chromeric.

A lock body 60 surrounds the plug body 48. The lock body 60 includes a rear end 62 having an inwardly directed flange 64 that tightly engages in the mounting step 52 near the rear end 50 of the plug body 48. The rear end 62 of the lock body 60 is further characterized by an outwardly extending stop flange 66.

A continuous cylindrical portion 68 projects forwardly from the rear end 62 of the lock body 60. The cylindrical portion 68 includes an outer cylindrical surface characterized by an inwardly extending lock groove 70. A plurality of resilient lock fingers 72 project forwardly from the cylindrical wall 68 of the lock body 60. The lock fingers 72 have a forward ends 74 characterized by outwardly projecting stop flanges 76. The lock fingers 72 further have major diameter locking shoulders 78 immediately rearwardly of the stop flanges 76 on the respective fingers 72. Portions on the fingers 72 rearward of the lock shoulder 78 define a minor diameter. The respective lock fingers 72 are characterized further by an inwardly projecting lock bead 80 at locations slightly rearwardly of the lock shoulders 78. The bead 80 is dimensioned to engage in the lock groove 42 on the adaptor 16.

The plug assembly 16 further includes a lock ring 82. The lock ring 82 includes a front end 84 defining a continuous cylindrical ring 86 with an inside diameter substantially equal to the outside diameter defined by the lock shoulder 78 on the fingers 72 of the lock body 60. A plurality of rearwardly directed lock fingers 88 project rearwardly from the continuous cylindrical ring 86. Each finger 88 includes an inwardly directed detent 90 dimensioned and configured for engaging in the lock groove 70 on the lock body 60.

The assembly 10 is employed by initially threading the adaptor 16 onto the standard female SMA connector 12 under factory conditions. The plug 14 can be connected to the assembled adaptor 16 and female SMA connector 12 by merely pulling the lock ring 82 rearwardly. Rearward forces on the lock ring 82 will cause the fingers 88 of the lock ring 82 to bias outwardly such that the detents 90 disengage from the lock groove 70 on the lock body 60. Thus, continued rearward movement of the lock ring 82 toward the step 66 on the lock body 60 is permitted. This rearward movement will disengage the continuous cylindrical portion 86 of the lock ring 82 from the locking shoulder 78, and thus will permit outward deflection of the lock fingers 72 on the lock body 60. As a result, the forward end 74 of the lock body 60 can be engaged over the adaptor 16. Continued forward movement of the plug 16 will cause the contact pin 44 to mate with the center contact 18 of the female SMA connector 12. Additionally, the mating portion 56 of the plug body 48 will telescope into the front end 30 of the outer shell 26 on the female SMA connector 12. At this point, the inwardly directed beads 80 on the lock body 60 will align with the lock grove 42 on the adaptor housing 16. The lock ring 82 then can be advanced back to its initial forward position with the detents 90 thereof engaged in the lock groove 70 of the lock body 60, and with the continuous cylindrical portion 86 thereof engaged over the lock shoulder 78. Thus, the plug assembly 16 is securely locked onto the adaptor 16 and is mated to female SMA connector 12. This mating can be achieved without the time consuming and cumbersome threaded engagement of a lock nut with the female SMA connector 12. The only threaded connection relates to the adaptor 16, and this threaded connection can be carried out under factor controlled conditions.

While the invention has been described with respect to a preferred embodiment, it is apparent that various changes can be made without departing from the scope of the invention.

What is claimed is:

1. A coaxial connector assembly comprising:

a first connector having an inner contact, an insulator surrounding the inner contact and an outer contact with an array of external threads;

a second connector comprising a center contact mateable with the center contact of the first connector, an insulator surrounding the center contact and an outer contact surrounding the insulator and mateable with the outer contact of the first connector;

a tubular adaptor with opposed mounting and mating ends, an array of internal threads being formed on the adaptor and being engaged with the threads on the first connector, the adaptor further having an outer cylindrical surface with an annular locking groove formed therein;

a tubular lock body with opposed mounting and mating ends, the mounting end being securely mounted around the outer contact of the second connector, an annular locking groove being formed around an outer surface of the lock body, a plurality of resiliently deflectable fingers extending to the mating end, each said resilient deflectable finger of the lock body having an inwardly projecting locking bead releasably engaged in the locking groove of the adaptor; and a tubular locking ring movably mounted around the lock body, the locking ring having opposed front and rear ends, the front end of the locking ring surrounding the resilient fingers of the lock body, a plurality of resiliently deflectable fingers extending to the rear end of the locking ring, each said finger having an inwardly projecting detent releasably engaged in the groove on the lock body, the locking ring being movable on the lock body from a forward position where the locking ring prevents outward deflection of the locking fingers of the lock body and a rearward position where the locking ring permits outward deflection of the locking fingers of the lock body for connecting and disconnecting the first and second connectors.

2. The coaxial connector assembly of claims 1 wherein the outer contact of the first connector includes an inner circumferential surface, the outer contact of the second connector having an outer circumferential surface dimensioned for sliding engagement with said inner circumferential surface of said outer contact of said first connector.

3. The coaxial connector assembly of claim 1 wherein a radius of the tubular adaptor passing through the annular locking groove also passes through the array of internal threads on the tubular adaptor.

4. The coaxial connector assembly of claim 1 wherein the tubular lock body has an annular stop flange substantially adjacent said mounting end for limiting movement of said tubular locking ring toward said mounting end, said tubular lock body further having outwardly projecting stop flanges at ends of said lock fingers adjacent said mating end for limiting movement of said tubular locking ring.

5. The coaxial connector assembly of claim 4, wherein the annular locking groove of the tubular lock body is a first annular locking groove; said tubular lock body further comprising a second annular locking groove disposed adjacent the annular stop flange, the inwardly projecting detents on the resiliently deflectable fingers of the tubular locking ring being releasably engageable in the second annular locking groove when the tubular locking ring is in the rearward position.

6. The coaxial connector assembly of claim 1, wherein the resiliently deflectable fingers of the tubular lock body each include an outwardly facing lock shoulder, the front end of the locking ring defining an inside diameter dimensioned for slidably engaging the shoulders of the resilient fingers of the lock body when the tubular locking ring is in the forward position.

7. The coaxial connector assembly of claim 6 wherein the locking ring is disposed rearwardly of the locking shoulders when the locking ring is in the rearward position.

* * * * *